US007297098B2

(12) United States Patent
Fell

(10) Patent No.: US 7,297,098 B2
(45) Date of Patent: Nov. 20, 2007

(54) CENTRIFUGAL SEPARATOR AND ROTOR THEREFOR WITH A RECESS DEFINING A DRIVE LIQUID CONDUIT

(75) Inventor: Anthony Fell, Somerset (GB)

(73) Assignee: Mann & Hummel GmbH, Ludwigsburg (DE)

( * ) Notice: Subject to any disclaimer, the term of this patent is extended or adjusted under 35 U.S.C. 154(b) by 63 days.

(21) Appl. No.: 11/220,867

(22) Filed: Sep. 8, 2005

(65) Prior Publication Data

US 2006/0063658 A1 Mar. 23, 2006

(30) Foreign Application Priority Data

Sep. 18, 2004 (GB) ..... 0420769.2

(51) Int. Cl.
*B04B 9/06* (2006.01)

(52) U.S. Cl. ..... 494/49

(58) Field of Classification Search ..... 494/24, 494/36, 43, 49, 64, 65, 67, 83, 84, 901; 184/6.24; 210/168, 171, 232, 360.1, 380.1, 416.5
See application file for complete search history.

(56) References Cited

U.S. PATENT DOCUMENTS 2,321,144 A * 6/1943 Jones ..... 494/15
2,335,420 A * 11/1943 Jones ..... 184/6.24
3,879,294 A * 4/1975 Ellis et al. ..... 210/354
5,779,618 A * 7/1998 Onodera et al. ..... 494/5
5,906,733 A 5/1999 Purvey
6,017,300 A 1/2000 Herman
6,019,717 A * 2/2000 Herman ..... 494/49

(Continued)

FOREIGN PATENT DOCUMENTS

DE 197 15 661 A1 10/1998

(Continued)

OTHER PUBLICATIONS

EP Search Report dated Jan. 20, 2006 (seven (7) pages).

*Primary Examiner*—Charles E. Cooley
(74) *Attorney, Agent, or Firm*—Crowell & Moring LLP

(57) ABSTRACT

A rotor (40) for a centrifugal separator (20) used for separating solid contaminants from pressurized engine lubricant, is driven by pressure of the lubricant, a portion of which is directed to, and expelled from rotor nozzles (88). The rotor comprises an open-type vessel (42), which in operation is only partially filled with liquid as an annular layer whose radial thickness is determined by outlet passages ($\mathbf{72}_1$ etc). The rotor is formed from a cap (62), an annular cup-like component (60) with a tubular wall (50) that in use surrounds a spindle and defines an inlet region (66) for pressurized liquid, and a drive member (84) having nozzles (88). The cap and cup-like component are individually molded from synthetic resin and joined to form a vessel (40). Inlet region (66) is connected to the cup by transfer passage (70). The base of the cup is molded with integral outlet passages ($\mathbf{72}_1$) and a recess (92) for receiving drive member (84), which defines a conduit directing pressurized liquid from the central region (66) to nozzles (88).

25 Claims, 5 Drawing Sheets

U.S. PATENT DOCUMENTS

| | | | | |
|---|---|---|---|---|
| 6,224,531 | B1 | 5/2001 | Frehland et al. | |
| 6,454,694 | B1 | 9/2002 | Herman et al. | |
| 6,740,026 | B2 * | 5/2004 | Samways | 494/12 |
| 6,893,389 | B1 * | 5/2005 | South et al. | 494/49 |
| 6,929,596 | B2 * | 8/2005 | Amirkhanian et al. | 494/49 |
| 2004/0152578 | A1 | 8/2004 | Samways | |
| 2004/0157719 | A1 * | 8/2004 | Amirkhanian et al. | 494/49 |
| 2006/0063658 | A1 * | 3/2006 | Fell | 494/49 |

FOREIGN PATENT DOCUMENTS

| | | | |
|---|---|---|---|
| DE | 20 2004 004 215 | U1 | 9/2005 |
| EP | 0 980 714 | A2 | 2/2000 |
| GB | 2 297 499 | A | 8/1996 |
| WO | WO 02/055207 | A1 | 7/2002 |

* cited by examiner

CENTRIFUGAL SEPARATOR AND ROTOR THEREFOR WITH A RECESS DEFINING A DRIVE LIQUID CONDUIT

BACKGROUND OF THE INVENTION

This invention relates to cleaning of contaminated liquid by centrifugal separation of denser contaminants, particularly separating out solids found in liquids such as lubricants used in internal combustion engines.

The use of centrifugal separators for such lubricant cleaning is well known in the art and has become particularly important as more vehicles use as fuel diesel oil that produces fine soot like particles and have to operate for considerable intervals without servicing of lubricant cleaning apparatus and change of lubricant.

Separating out solid contaminants depends upon passing the liquid though a rotating separation and containment vessel and the efficiency of separation is related both to the speed of rotation and time spent by the liquid in transiting the vessel.

Such contaminants make it necessary to rotate the centrifuge separation and containment vessel at higher speed than previously needed in the art, although this in turn has led to more complex designs. Whereas traditional constructions relied upon the liquid passing through the rotor container filling it and at such pressure as to create a reaction thrust as it was ejected by way of reaction jet nozzles, this was perceived to be unable to rotate a container filled with liquid adequately, the through-flow required for high speed rotation and radial pressure gradient across the container being in conflict with obtaining proper dwell time of the liquid within the container to effect separation. In order to achieve better rotation it has been suggested to separate the liquid driving the rotor from that passing through the rotor for cleaning. GB 2297499 employs liquid from a high pressure source separate from that being cleaned in the rotor. U.S. Pat. No. 6,454,694 describes splitting the contaminated liquid supplied to the rotor at elevated pressure and diverting a portion of it directly to reaction jet nozzles to supplement that passed through the separation and containment chamber. Other devices, such as EP 0980714 A2 employ an impulse turbine rather than liquid jet reaction turbine to effect high speed rotation.

Although such separate driving enables a more relaxed dwell time to be achieved for the liquid to be cleaned, it will be seen from the above that such arrangements can result in complicated, and thus expensive, rotor constructions. Furthermore, it is believed by inter alia the present applicant that such efforts to increase efficiency by increasing the rotation speed are nevertheless compromised by having to rotate a vessel filled with liquid. Such a filled vessel not only has considerable inertia that is in conflict with frequent starting and stopping of the engine, but retains the internal pressure gradient profile that conflicts with efficient separation unless internal structural features are employed that reduce throughput of the liquid.

Such rotor types which are operated filled with liquid and exhibit a pressure difference between the contained liquid and the surrounding environment may be considered as being of a "closed" rotor type, Traditionally the cost of providing such centrifugal cleaning has confined its application to commercial vehicles, such as trucks, whose high degree of usage between servicing intervals is combined with the use of diesel engines that introduce particulate products of combustion into the lubricating oil. However, as such engines become more commonplace in passenger vehicles the benefits of centrifugal separation in engines of these vehicles are manifest as the lesser usage is more than offset by the requirement for long intervals between servicing, but such smaller and competitively priced vehicles place their own constraints on the overall cost of employing such separation in addition to conventional filtration.

The costs associated with having such a separator in the lubricant cleaning system of a vehicle include not only the directly quantifiable ones of manufacture and disposal in relation to the cost of the vehicle per se but also the less quantifiable ones of added weight to be carried around by the vehicle and power consumed in operation. It has been proposed for, example in DE 19715661 A1, to have such a closed type of rotor manufactured from synthetic resin (i.e., plastic) materials instead of the usual steel sheet, but the stresses imposed by rotating a large body of contained liquid require reinforcement that detracts from the apparent simplicity of substitution by a lighter material.

It has been proposed, as in WO 02/055207, the contents of which are incorporated herein by reference, to employ a so-called "open" rotor in which the liquid to be cleaned does not fill the whole chamber created by the rotor contaminant separation and containment vessel but is confined to a radially relatively thin zone or layer adjacent the vessel outer wall by virtue of outlet passage separated from the rotation axis and through which liquid is capable of being discharged at a rate in excess of its supply to the vessel. Liquid freshly introduced into the vessel is able to reach the zone adjacent outer wall, where separation is most efficient, without the pressure gradient of a filled rotor and the inertia of the rotor is reduced in accordance with the reduced amount of liquid held.

Having determined a more satisfactory principle of operation there nevertheless remains the problem of providing such cleaning benefits economically when there are cost constraints associated with particular vehicular types. As mentioned above, the costs associated with having a centrifugal separator in the lubricant cleaning system of a small passenger vehicle thus include both the costs of manufacture and disposal and of operation.

Whereas some of the indirect costs of operating may be mitigated by the "open" rotor approach and wide choice of materials suitable, there is still the need to consider construction in respect of initial manufacture and in respect of disposal that is now governed by legislation relating to separation and recycling of different materials.

SUMMARY OF THE INVENTION

It is an object of the present invention to provide an improved rotor for a centrifugal separator.

Another object of the present invention is to provide for a centrifugal separator a rotor of simple design that mitigates cost disadvantages of previous rotors.

It is furthermore an object of the present invention to provide a centrifugal separator including such rotor and a liquid cleaning arrangement including such a centrifugal separator.

These and other objects are achieved in accordance with the present invention by providing a rotor for a fluid driven centrifugal separator having a housing comprising a base and a cover and within the housing a spindle extending from the base to support for rotation a said rotor and having a through duct to communicate fluid at elevated pressure from the base to the rotor; the rotor comprising a contaminant separation and containment vessel having a rotation axis and, extending axially between first and second ends, an annular chamber defined by an axially extending inner tubular wall surrounding and radially spaced from the rotation axis, an axially extending outer tubular wall arranged to surround the inner tubular wall spaced radially therefrom, a first end wall extending between the inner and outer tubular walls, and a second end wall extending between the inner and outer tubular walls at the end of the chamber opposite said first end wall; the inner tubular wall having a liquid transfer passage extending therethrough, displaced from the first end, and the first end wall having vessel outlet passage therethrough, displaced radially from the outer tubular wall, capable of passing liquid at a greater rate than the transfer passage; the rotor also comprising a liquid inlet region defined by, and disposed radially inwardly of, the inner tubular wall, a bearing for supporting the rotor with respect to the housing and liquid powered turbine; wherein the turbine comprises a liquid reaction drive having a drive member, secured with respect to the vessel, including a collar at said first end of the inlet region, arranged to fit in substantially liquid tight manner about the spindle in use, and at least one arm extending radially from the collar overlying the first end wall of the vessel, each arm carrying remotely of the collar a substantially tangentially directed reaction jet nozzle and defining a drive liquid conduit between the inlet region and nozzle; said vessel outlet passage comprising at least one passage having a discharged liquid guide extending away from the first end wall arranged to discharge liquid expelled from the chamber axially further from the first end wall than each nozzle of the drive, and an inlet region closure co-operable with the spindle in use to permit liquid supplied by the spindle to the inlet region at elevated pressure from leaving other than through the transfer passage and the liquid reaction drive.

According to a first aspect of the present invention a rotor for a fluid driven centrifugal separator, of the type having a housing comprising a base and a cover and within the housing spindle extending from the base to support for rotation a said rotor and having a through duct to communicate fluid at elevated pressure from the base to the rotor, comprises a contaminant separation and containment vessel having a rotation axis and, extending axially between first and second ends, an annular chamber defined by an axially extending inner tubular wall arranged to surround and to be spaced radially from the rotation axis, an axially extending outer tubular wall arranged to surround the inner tubular wall spaced radially therefrom, a first end wall extending between said inner and outer tubular walls, and a second end wall arranged to extend between the inner and outer tubular walls at the end of the chamber opposite to the first end wall, the inner tubular wall having liquid transfer passage extending therethrough, displaced from the first end, and the first end wall having vessel outlet passage therethrough, displaced radially from the outer tubular wall, capable of passing liquid at a greater rate than the transfer passage, the rotor also comprising a liquid inlet region defined by, and radially inwardly of, the inner tubular wall, bearing to support the rotor with respect to the housing and liquid powered turbine, in which the turbine comprising liquid reaction drive having a drive member, secured with respect to the vessel, including a collar at said first end of the inlet region, arranged to fit in substantially liquid tight manner about the said spindle in use, and at least one arm extending radially from the collar overlying the first end wall of the vessel, each arm carrying remotely of the collar a substantially tangentially directed reaction jet nozzle and defining a drive liquid conduit between the inlet region and nozzle, by said vessel outlet passage comprising at least one passage each having a bounding skirt extending away from the first end wall arranged to discharge liquid expelled from the chamber axially further from the first end wall than each nozzle of the drive, and by inlet region closure co-operable with said spindle in use to permit liquid supplied by the spindle to the inlet region at elevated pressure from leaving other than by way of the transfer passage and the liquid reaction drive.

According to a second aspect of the present invention a centrifugal separator for separating particulates from a liquid comprises a housing having a base, arranged to be coupled to a source of contaminated liquid at elevated pressure, a spindle, mounted with respect to the base and having a duct to communicate fluid at elevated pressure from the base, and a cover secured with respect to the base, the separator further having a rotor mounted within the housing on the spindle for rotation and to receive said liquid at elevated pressure from the spindle, the rotor being substantially as defined by the preceding paragraph.

According to a third aspect of the present invention a liquid cleaning arrangement comprises means to supply contaminated liquid at elevated pressure and a centrifugal separator as defined in the preceding paragraph.

BRIEF DESCRIPTION OF THE DRAWINGS

The invention will be described in further detail hereinafter with reference to illustrative preferred embodiments shown in the accompanying drawing figures, in which:

FIGS. 8 (*b*) and 8 (*c*) are plan view of the end of the vessel and drive member respectively of the rotor of FIG. 8 (*a*);

DETAILED DESCRIPTION OF PREFERRED EMBODIMENTS

Figure 1:
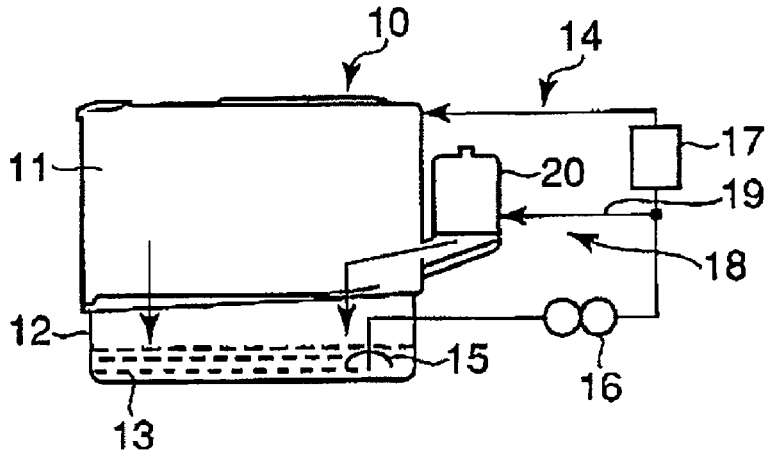
FIG. 1 is a schematic representation of an internal combustion engine incorporating a pressurized liquid lubrication system and a liquid cleaning arrangement, including a liquid driven centrifugal separator, in accordance with the present invention.

Referring to FIG. 1, an internal combustion engine 10 comprises an engine block 11 containing moving parts (not shown) requiring lubrication and at the bottom a sump 12 that comprises a reservoir for the collection and storage of liquid lubricant 13 draining from the engine block. A lubrication arrangement, indicated generally at 14, comprises a liquid pick-up 15 that leads to a pump 16 operable to drive the liquid through a full-flow filter element 17 to the moving parts of the engine from which it drains by gravity to the sump. Additionally, some of the pumped liquid is diverted to flow in a circuit 18 through line 19 and a centrifugal separator 20 from which it also drains by gravity to the sump, bypassing the moving parts of the engine.

Figure 2:
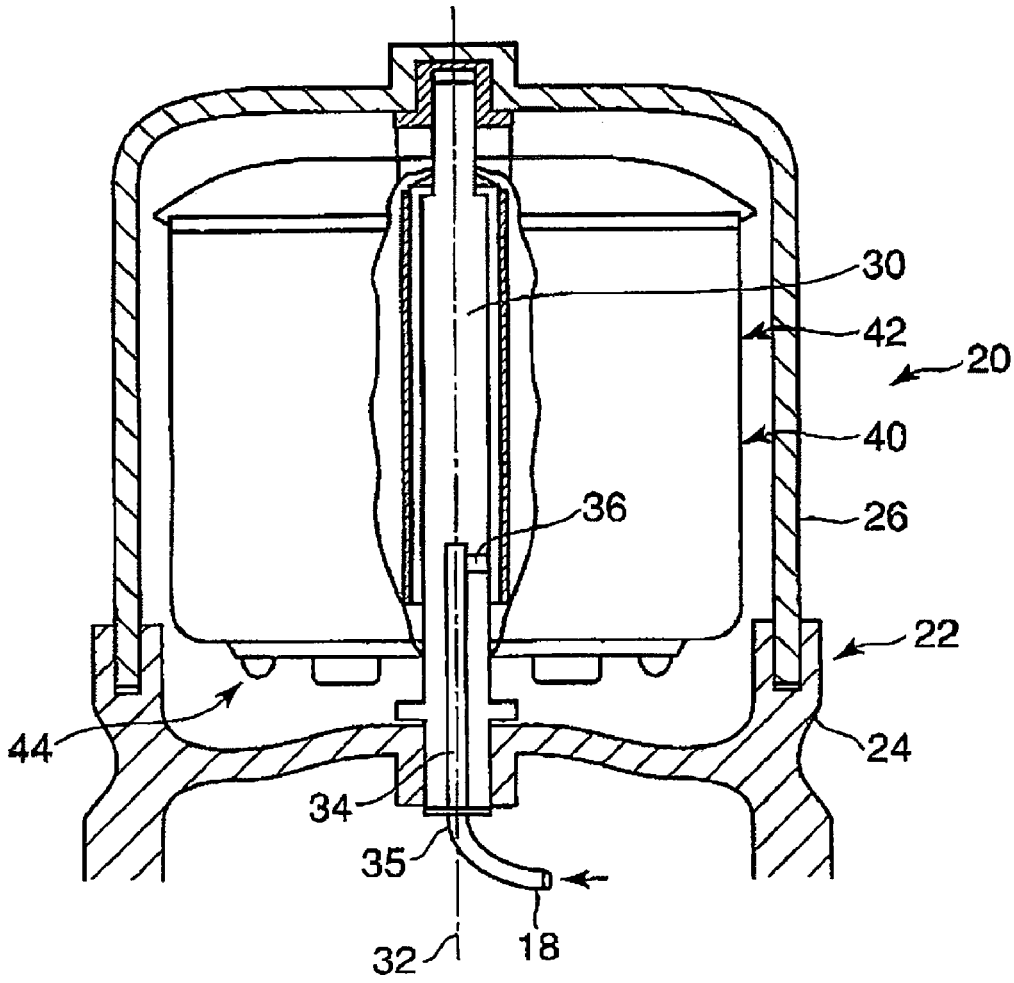
FIG. 2 is a partly sectioned elevation view of the centrifugal separator of FIG. 1, showing a housing including a spindle and mounted on the spindle for rotation relative to the housing a rotor in accordance with the present invention.
Figure 3:
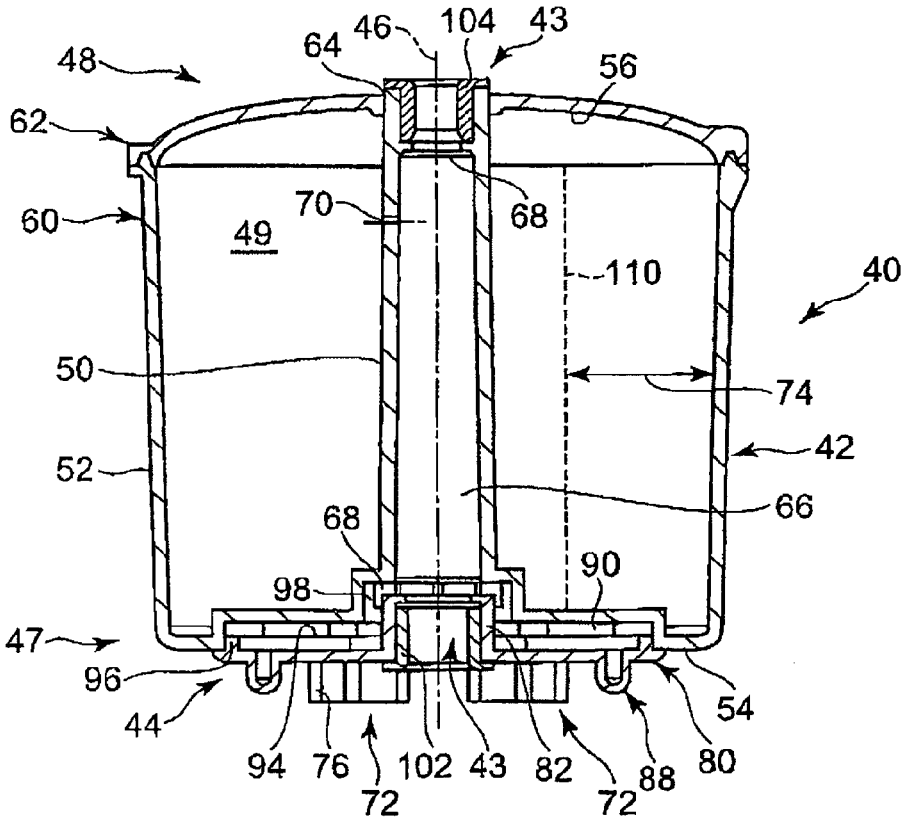
FIG. 3 is a sectional elevation through the rotor of FIG. 2 showing formation of a closed vessel by an open-topped annular cup molding and a cap secured thereto, and reaction turbine drive disposed beneath the vessel.
Figure 4:
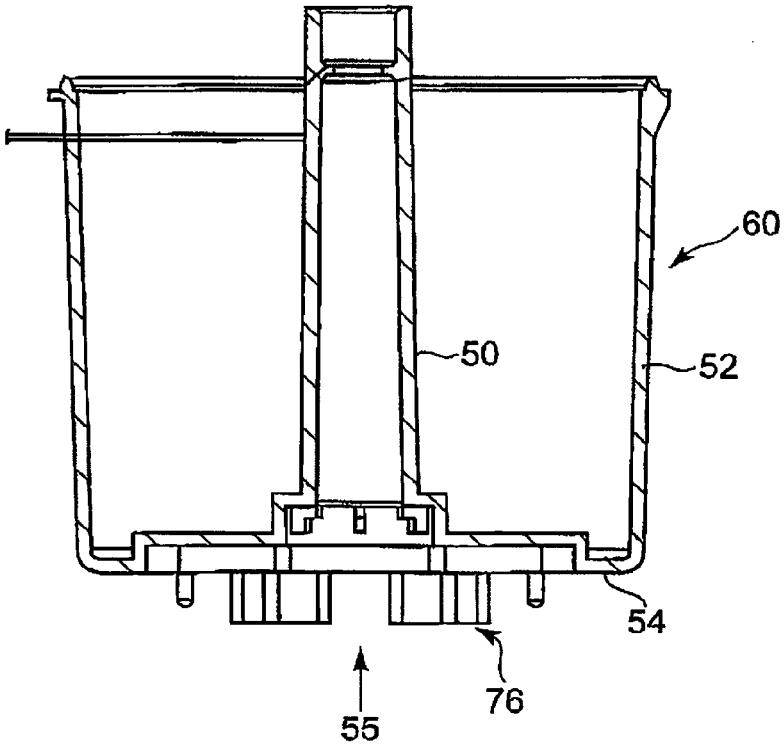
FIG. 4 is a sectional elevation through the annular cup of the vessel of FIG. 3.
Figure 5:
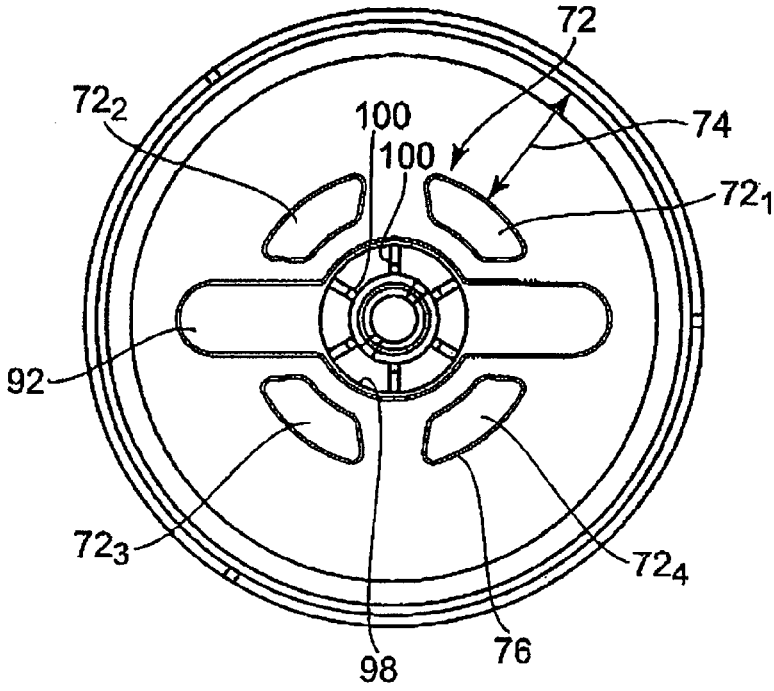
FIG. 5 is a view along the line 5-5 of FIG. 4 showing the annular cup from below.

Referring to FIG. 2, the centrifugal separator 20 comprises a housing 22 comprising in turn a cast or molded base 24 and a removable cover 26 which when in situ seats with respect to the base and forms therewith a substantially liquid tight seal. Insofar as the housing is intended to have liquid therein, from which it can drain via the base to the sump by gravity, the housing is substantially at ambient pressure and the sealing requirements between cover and base are not stringent.

The housing also contains spindle 30 in the form of a single spindle which is mounted in, and fixed in relation to, the base 24 extending along the housing to, and forming a location with, the cover 26. As is conventional in centrifugal separators, the spindle extends upwardly from the base 24, its longitudinal axis 32 being substantially vertical, although departure from such orientation is permissible and envisaged.

The spindle has extending therethrough along pat of its length a duct 34 that is fed at the lower end 35 of the spindle by liquid at elevated pressure from the pump 16. The feed may be direct as shown or by a duct (not shown) through the base. A cross-drilling 36 displaced axially from the end of the spindle discharges the liquid laterally of the spindle. The spindle provides support for, and permits rotation thereabout, of a rotor 40 that is in operation contained within the housing.

Referring to FIGS. 3 to 7, the rotor comprises a contaminant separation and containment vessel 42, bearing 43 to support it on the spindle and permit rotation, and liquid powered turbine 44 to effect that rotation.

The vessel is defined along and about a longitudinal axis 47 which, when the vessel is disposed with respect to the spindle is coincident with the longitudinal axis 32 of the spindle and constitutes a rotation axis. The vessel 42 extends axially between a first end, indicated generally at 47, and a second end, indicted generally at 48, and between the ends an annular separation and containment chamber 49 is defined by an axially extending inner tubular peripheral wall 50, which is dimensioned to surround and be spaced radially from the spindle 30, and an axially extending outer tubular wall 52 spaced radially from, and surrounding, the inner tubular wall.

At the first end 47 of the vessel, a first end wall 54 extends between the inner and outer tubular walls and at the second end 48 a second end wall 56 extends between the inner and outer tubular walls.

With regard to the upstanding disposition of the housing spindle and intended orientation of the vessel with respect to the housing, that is with its longitudinal axis 46 vertical, the first end 47 is when used lowermost and adjacent the base 24, and the rotor parts including the vessel end walls may for convenience and ease of description be referred to in terms of such intended orientation, notwithstanding the rotor, separate from the spindle, may assume any orientation.

In this embodiment the inner tubular wall 50 is of greater axial extent than the outer tubular wall 52 and the vessel is made of two component parts 60 and 62 joined together. Furthermore, each of the parts is made of the same material, being a synthetic resin material, such as nylon 66, that can be molded to shape and has sufficient structural strength and temperature tolerance that permits operation in a hot engine with hot lubricant.

Figure 6:
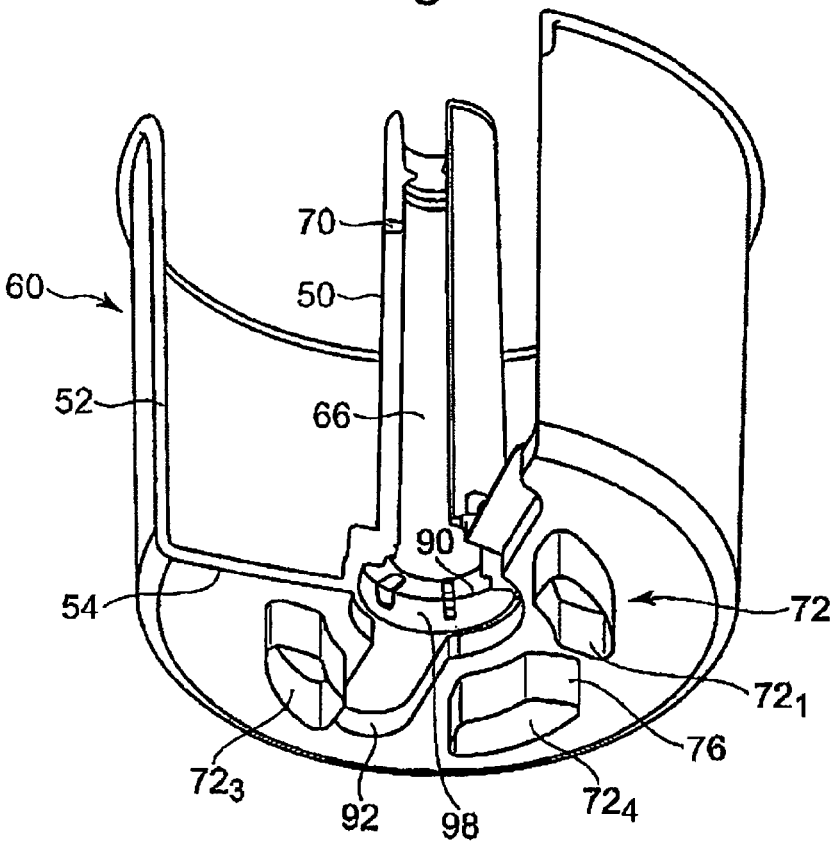
FIG. 6 is a perspective, partly cut-away view of the annular cup of FIG. 4, illustrating discharged liquid guide associated with each outlet passage.
Figure 7:
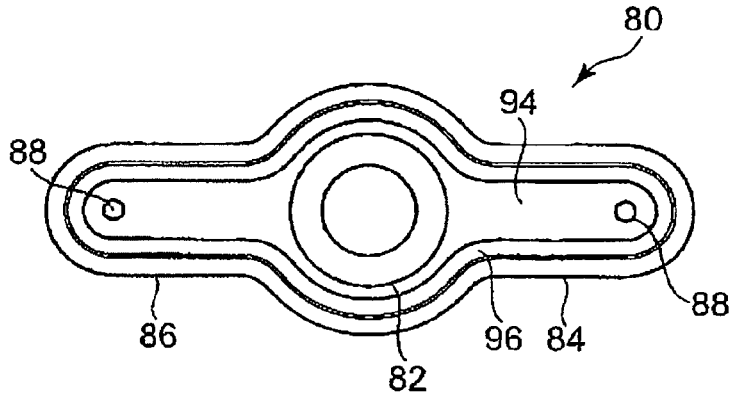
FIG. 7 is a plan view of the drive of FIG. 3 separated from the vessel.

The first component part 60 comprises a cup in which the inner and outer tubular walls and first end wall 50, 52 and 54, are integrally defined as a unitary molding, shown (partially cut away) in FIG. 6. The second component part 62 comprises a molded cap which is apertured at 64 to surround the inner tubular wall 50 and seats on the end of the outer tubular wall 52 in order to define second end wall 56.

The inner tubular wall 50 defines radially inwardly thereof a liquid inlet region 66. In use, the inlet region is, of course, defined around the spindle and receives liquid by way of the drilling 36 in the spindle. The liquid inlet region 66, insofar as it is defined by cup 60, is open towards the first end although the region in the assembled rotor is stopped axially by inlet region closure, indicate generally at 68 and described below that permits liquid to be retained in the region at the elevated pressure of delivery from the spindle.

The inner tubular wall 50 has transfer passage 70, comprising at least one transfer passage, extending through the wall and displaced from the first end 47. Each transfer passage provides liquid communication between the liquid inlet region and the chamber defined by the vessel, preferably in the form of a spray.

The first end wall 54 of the vessel has vessel outlet passage, indicated generally at 72, comprising at least one, but preferably a plurality of outlet passages $\mathbf{72}_1$, $\mathbf{72}_2$, . . . $\mathbf{72}_4$ arrayed about the longitudinal rotation axis 46 and displaced radially from the outer tubular wall 52 of the vessel. The passages $\mathbf{72}_1$ etc are dimensioned so that together they are capable of passing liquid at a greater rate than the transfer passage, the radial positioning thereof defining the radial thickness of an annular separation and containment zone 74 of the vessel as described in the aforementioned WO 02/055207.

As seen in FIGS. 2-5, there is also provided a discharged liquid guide comprising, associated with each outlet passage $\mathbf{72}_1$ etc. a bounding skirt 76 extending away from the first end wall axially such that liquid expelled from the rotating vessel is discharged without fouling the rotor. The guide is described in detail below.

The rotor also comprises the aforementioned liquid powered turbine 44 to effect rotation relative to the housing, about the spindle. The turbine comprises reaction drive that is constituted mainly by a drive member 80 secured with respect to the vessel at its first end. The drive member comprises a collar 82 arranged to fit in substantially liquid tight manner about the spindle at the first end of the inlet region and a pair of arms 84 and 86 extending radially from the collar overlying the exterior of the first end wall of the vessel. Conveniently the collar and arms are formed integrally as a one-piece or unitary molding of the same material as the cup 60. Each arm carries remotely of the collar a substantially tangentially directed reaction jet nozzle 88 and defines a drive liquid conduit 90 between the inlet region and nozzle. Although the drive member may be formed with a closed conduit leading to the nozzle, it is preferred that the drive liquid conduit is defined at least in part by the surface of the vessel end wall. In this embodiment the first end wall of the vessel has therein a recess 92 corresponding to each radially extending arm of the drive member, and each arm overlies and closes a respective radially extending branch of the recess so as to define drive liquid conduit 90 at least partly within said recess, the conduit walls being the vessel wall and drive member arm which forms a liquid containment surface 94.

It will be appreciated that the conduit may be formed completely recessed by having each drive member arm in the form of a substantially flat cover plate, except for the nozzle, but preferably, as shown, the drive member defines each liquid containment surface as a trough open towards the end wall by virtue of each drive member arm having an upstanding peripheral rib 96 dimensioned to be received in the associated first end wall recess 92. To improve liquid tightness between the liquid containment surface and vessel wall, the drive member is secured with respect to the vessel by way of each arm and the first end wall. Although such a rib 96 may effect a liquid tight joint mechanically, the drive member is, in general, secured with respect to the vessel by adhesives or welding (ultrasonic welding if of synthetic resin materials) and independently of the provision of such rib. It will be appreciated that if each drive member arm 84, 86 defines liquid containment surface 94 as an open trough, the drive liquid conduit may be defined between the arm and the vessel wall without need to recess the latter, although such recess does permit the amount by which the drive extends axially proud of the end wall of the vessel to be kept to a minimum.

In addition to the first end wall 54 of the vessel being recessed to define the drive liquid conduits, the inner tubular wall has adjacent said first end a recess 98 of increased diameter to receive the drive member collar 82. The recess is lined with projections 100 that not only facilitate disposing of the collar as an interference fit but also provide paths between the inlet region and conduits for the drive liquid.

Insofar as both the reaction jet nozzles 88 of the drive and the outlet passages $\mathbf{72}_1$ etc both discharge drive liquid into the housing below the first end wall of the rotor vessel it is preferred to keep these streams of liquid from intermingling in a manner that may compromise rotation efficiency. To this end, in this embodiment the end wall recess 92 and each arm 84, 86 of the drive member is disposed to extend radially outwardly of the outlet passages $\mathbf{72}_1$ etc and the discharged liquid guide skirt 76 bounding each outlet passage is of such length in an axial direction as to discharge expelled liquid axially further away from the first end wall 54 than each nozzle of the drive and radially closer to the rotation axis than each nozzle of the drive, made more practicable by partially recessing the drive.

It will be appreciated that in separator use it is necessary both to support the rotor with respect to the spindle by bearing 43 and create an elevated liquid pressure in the inlet region 66, which serves as the source of liquid for the transfer passage 70 and reaction turbine drive 44. Consequently it is necessary to inhibit spindle-supplied liquid at elevated pressure in the inlet region from leaving it other than by way of the vessel transfer passage 70 and to liquid reaction drive, that is, from escaping along the spindle. To this end, the bearing 43 is provided by two bearing bushes 102 and 104 separated axially, a first or lower bush 102 being carried by the collar 82 of the drive and the second or upper bush 104 being carried by the inner tubular wall 50 at its second end. Insofar as each bush is chosen with respect to the spindle with which to be used to be a close fit thereon and lubricated by a film of liquid permitted to seep from the inlet region, the pair of bushes constitute both bearing and closure.

Operation is essentially as described in the aforementioned WO 02/055207, insofar as liquid is introduced into the vessel by way of the transfer passage at a rate determined by transfer passage area and inlet region pressure. Liquid from the inlet region is also directed to the drive to effect rotation of the rotor. Liquid within the vessel is disposed by centrifugal forces of rotation towards the side wall 42 upon which it builds an annular layer having radially facing surface indicated by broken line 110.

Although the atmosphere in the vessel is substantially at ambient atmospheric pressure, there is a radial pressure gradient within the annulus of contained liquid. When the liquid builds up such that the surface reaches the position of the edges of the outlet passage, the lip of each passage acts as a weir and liquid flows along the passage at the same rate it is transferred into the vessel and is guided to be discharged.

It will be appreciated that insofar as liquid discharged by way of each outlet passage detaches itself from the boundary of the passage and when free is subject to motion, determined by the forces acting on it at the time of detachment, that take it in a substantially straight line direction different from the adjacent end wall 54 of the rotating vessel, contact between such detached discharged liquid and the vessel wall is a source of drag to compromise rotation of the vessel. Thus the discharged liquid guide directs the liquid exiting the vessel so that it is discharged from the rotor spaced axially from the base of the rotor, that is, both the end wall 54 and overlying drive member 80 standing proud of the wall.

It will be appreciated that in principle the discharged liquid guide skirt is necessary only at the radially outer edge of the passage and the trailing edge with respect to rotation direction, and in respect of any individual outlet passage the guide skirt may be incomplete in encircling the passage. Furthermore, any outlet passage and/or discharged liquid guide may have a shape other than the circle segment shown.

Insofar as the liquid in the vessel and each outlet passage is subject to a radially outwardly acting (centrifugal) force and upon detachment tends to leave from the rotationally trailing edge of the outlet passage, it is also found that detachment of liquid per se from the discharged liquid guide also may create drag and it is contemplated that the drag effects caused by the discharged liquid detachment may be mitigated in a number of ways.

In accordance with the principles of the present invention, arrangements for achieving this preferably have regard to the aim of economic manufacture of the rotor as well as efficiency. Most simply, as a variant of the above, the discharged liquid guide skirts may be inclined with respect to the axial direction in radial or trailing tangential direction or combination of both.

Figure 8:
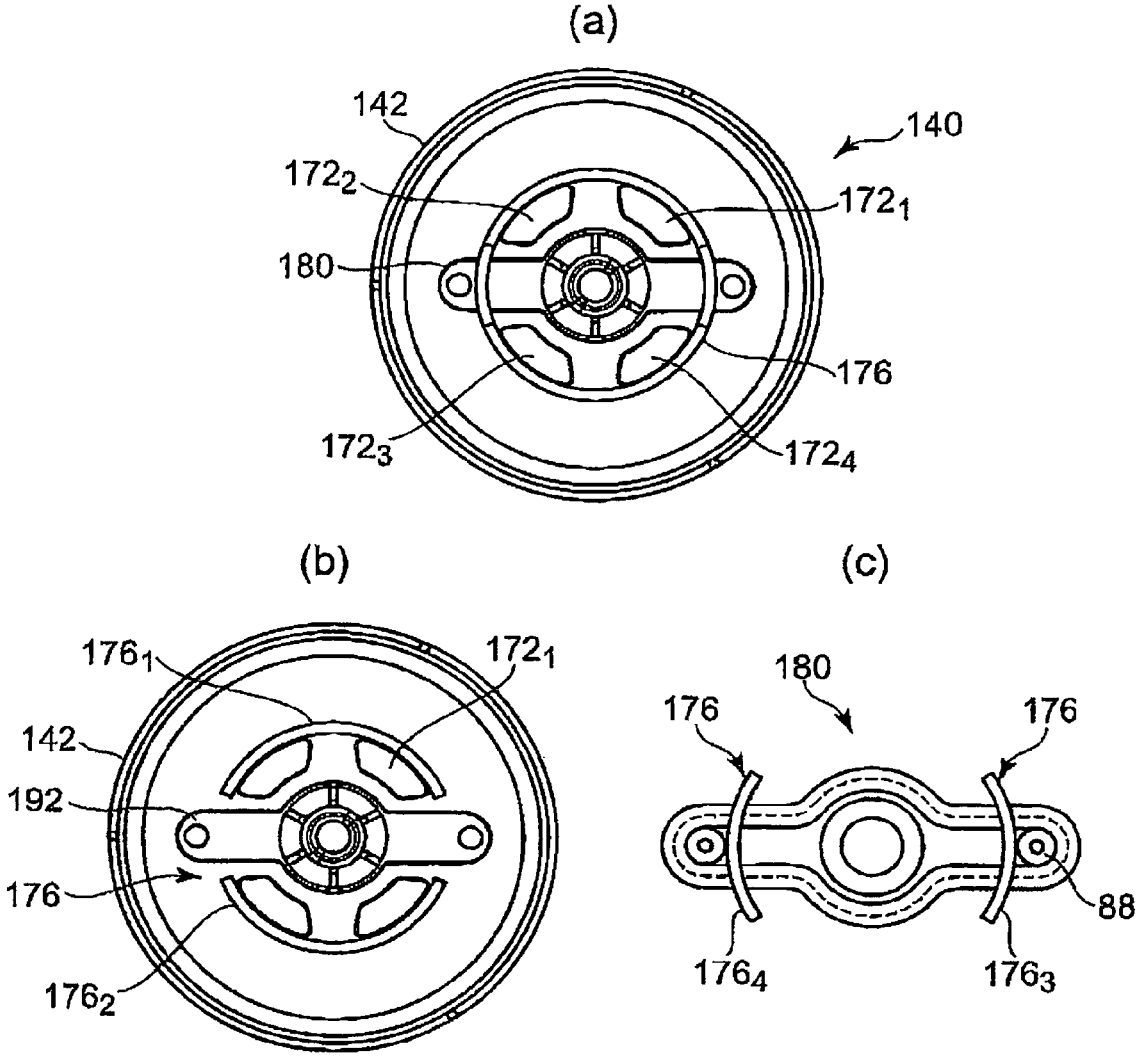
FIG. 8 (*a*) is a an end view of a further form of rotor showing a variant of discharged liquid guide.

Referring now to FIG. 8 (*a*), a rotor 140 comprises vessel 142 having a first end wall 154 defined with recess 192, drive member 180 and array of outlet passages $\mathbf{172}_1$, $\mathbf{172}_2$ etc and as an alternative to a plurality of outlet passages $\mathbf{72}_1$ etc individually skirted, and a single annular discharged liquid guide skirt 176 defined encircling the outlet passage as a whole. Referring to FIGS. 8 (*b*) and 8 (*c*) showing the components of rotor 140, having regard to the form of the vessel 142 with recess 192 in the end wall and drive member 180 to be accommodated therein and against a portion of the end wall, the annular discharged liquid guide skirt 176 may be formed in sections, such as $\mathbf{176}_1$ and $\mathbf{176}_2$ carried by, and conveniently integrally formed with, the vessel end wall, and sections $\mathbf{176}_3$ and $\mathbf{176}_4$ carried by, and conveniently formed integrally with, the arms 184 and 186 of the drive member. It will be seen that when the member is secured with respect to the vessel end wall the annular discharged liquid guide skirt is created.

Figure 9:
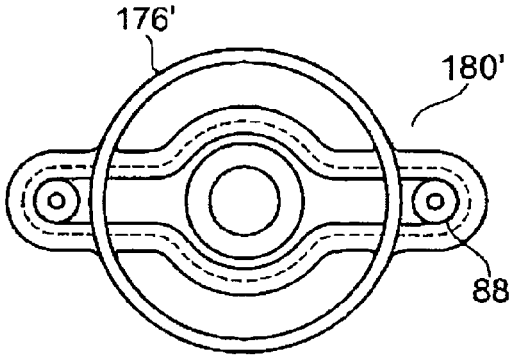
FIG. 9 is a plan view of a drive member showing a variant of the discharged liquid guide of FIG. 8 (*a*)

A variant of this is shown for rotor x in FIG. 9 wherein the drive member 180' is formed carrying an annular ring 176' which, when the member is secured with respect to the vessel end wall, abuts the end wall and provides a discharged liquid guide skirting the whole outlet passage.

Figure 10:
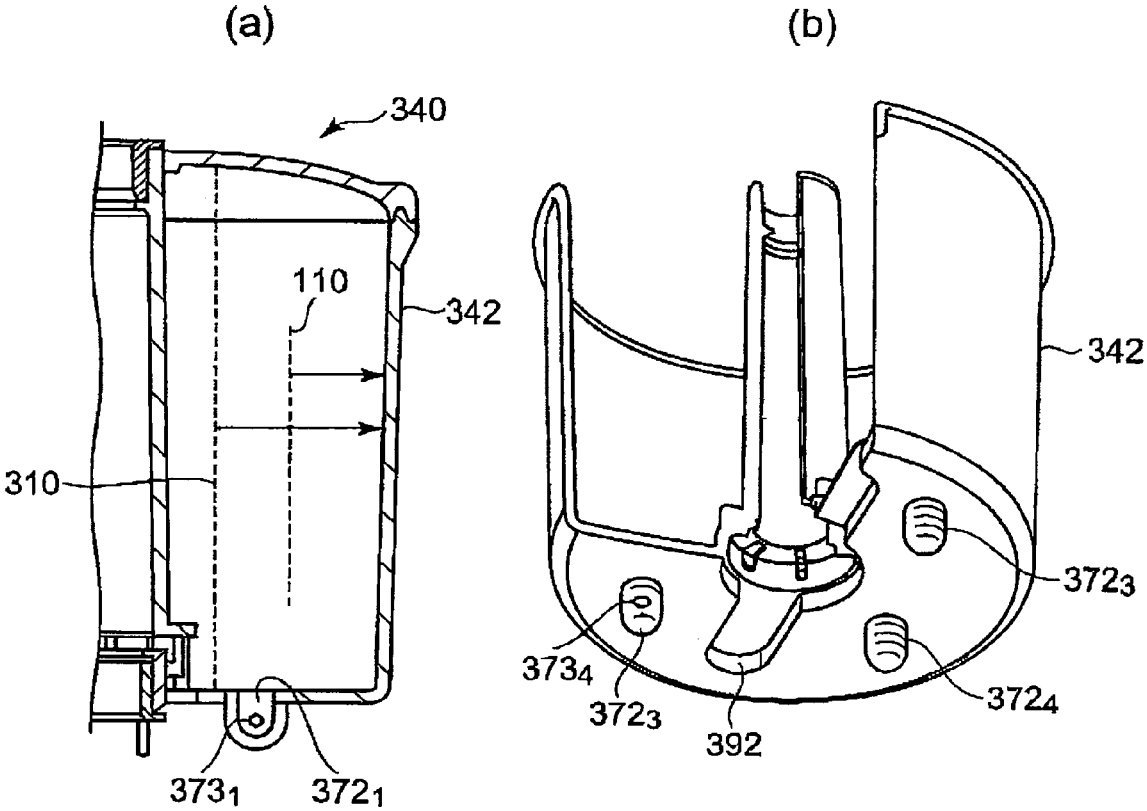
FIG. 10 (*a*) is sectional elevation through part of a rotor vessel showing yet another form of discharged liquid guide as axially terminated, tangentially directed nozzles, and FIG. 10 (*b*) is a perspective, partly cut-away view of the vessel of FIG. 10 (*a*).

A further form of outlet passage with discharged liquid guide arrangement is illustrated for rotor 340 in FIGS. 10 (*a*) and 10 (*b*). In this form rotor vessel 342 has the outlet passage, shown at 372 comprising one or more outlet passages $\mathbf{372}_1$, $\mathbf{372}_2$ etc. differing from the slot-like passages of the above described embodiments and each being closed axially and terminating in a nozzle $\mathbf{373}_1$ etc. spaced axially from the end wall of the vessel and the jet reaction nozzles of drive member 380. Although it is not essential, each discharge outlet nozzle points in a direction that may be tangential, radially outward or a combination thereof with respect to the rotation direction of the vessel.

In all of these embodiments the outlet passages ensure that as the liquid admitted to the rotor vessel forms an annular layer building radially from the outer side wall 42, 142 etc., then notwithstanding the existence of a radial pressure gradient within the liquid annulus, the (radially inward) surface is substantially at ambient atmospheric pressure so that when the surface reaches the lip of an outlet passage, the lip forms a weir and the surface has to grow only marginally beyond the lip for the liquid to flow along the passage and be discharged. Provided there is no impediment to the flow a status quo is reached that defines the maximum radial thickness of the annular layer of liquid in the vessel.

In the outlet passage 72 of vessel 42, the outlet passages $\mathbf{72}_1$ etc. are clearly large in relation to the transfer passage 70 such that irrespective of the liquid supply pressure, they are always able to permit liquid to discharge without filling the vessel substantially beyond the radial position of the lips of the outlet passage. The outlet passages $\mathbf{372}_1$ etc. of nozzle form may also be arranged to pass liquid under the same conditions, providing a discharged liquid guide that simply guides the liquid through a change in direction of discharge in addition.

However, having regard to the manipulation of flow into the vessel through the transfer passage by choice or variation of both transfer passage area and the pressure difference thereacross, the outlet passage may be constructed to be manipulated in analogous manner. By having the outlet passages, most conveniently nozzles $\mathbf{373}_1$ etc., dimensioned such that outflow of liquid from the vessel does not readily exceed that of the transfer passage, the annular liquid layer in the vessel is permitted to grow radially such that its surface is radially inwardly of the outlet passage, as shown at 310 in FIG. 10 (*b*). However, as the radial surface of the liquid annulus moves beyond the outlet passage 370 such that the latter is submerged within the liquid, the outlet passages are also exposed to the radial pressure gradient that exists within the spinning liquid, and a pressure difference exists across each outlet passage in the axial direction that forces discharge of liquid from the vessel. The actual discharge rate is made to match the transfer of liquid into the vessel and prevent continued radial growth of the liquid annulus within the vessel by dimensioning the outlet passage in relation to the transfer passage 70 and inlet region pressure. Thus, it is possible to balance to outlet of liquid from the vessel such that a small, but significant, liquid pressure encourages outflow but without allowing the vessel to become filled, thus preserving the operating principles of the open centrifuge that the outlet passage is capable of passing liquid from the vessel at a greater rate than it is admitted by the transfer means, albeit dependant upon a pressure gradient in the liquid generated by rotation.

Although not restricted to outlet passages of nozzle form, by combining such pressure assisted discharge with the use of such outlet passages of nozzle form that introduce a directional change, it is possible, by directing discharged liquid in a direction having at least a component opposite to the rotation direction of the rotor, to utilize the energy loss caused by its ejection from the vessel to mitigate any effects of drag and possibly augmenting the drive force provided by the nozzles 88 of the turbine drive.

It will be appreciated also that insofar as the discharge nozzles 88 of the drive and vessel outlet passages $\mathbf{72}_1$ etc. and $\mathbf{372}_1$ etc. are spaced apart radially the housing base 24 may be shaped (not shown) to provide a collector for collecting the respective liquid streams soon after their discharge and directing them to drain from the housing without mutual interference.

Other variations of construction will be appreciated by those skilled in the art. The vessel may be assembled from a larger number of components and/or differing materials. The bearing may be provided by other than bushes and notwithstanding the bearing form these may be mounted other than as shown; for instance, the lower bearing could be mounted within the inner tubular wall rather than the collar of the drive, which collar could then be reduced to vestigial form.

The number of arms to the drive member may be varied, as may the number of ducts of the outlet passage. Furthermore, although the arms and complementary recesses in the vessel end wall are shown extending strictly radially, they may also have a circumferential component so as to take on a swept appearance.

Although the rotor has been shown in an embodiment in which both the drive and outlet passage are at the same, operationally lower end of the rotor, either or both means may, in accordance with the general teaching of the open rotor centrifugal separator be disposed at the upper end of the rotor.

Furthermore, the invention has been described in relation to a centrifugal separator having a spindle extending therethrough and fixed with respect to, the housing and about which the rotor is driven. It will be appreciated that the rotor as shown may operate with a pair of spindle stubs extending from the housing base 24 and cover 26 respectively but not extending all the way through the inlet region. Alternatively, an elongate spindle or a pair of spindle stubs may be fixed with respect to the inner tubular wall, and optionally the drive collar, such that the vessel rotates relative to the housing but not relative to the spindle or spindles.

The foregoing description and examples have been set forth merely to illustrate the invention and are not intended to be limiting. Since modifications of the describe embodiments incorporating the spirit and substance of the invention may occur to persons skilled in the art, the invention should be construed broadly to include all variations within the scope of the appended claims and equivalents thereof.

What is claimed is:

1. A rotor for a fluid driven centrifugal separator having a housing comprising a base and a cover and within the housing spindle extending from the base to support for rotation a said rotor and having a through duct to communicate fluid at elevated pressure from the base to the rotor;

the rotor comprising a contaminant separation and containment vessel having a rotation axis and, extending axially between first and second ends, an annular chamber defined by an axially extending inner tubular wall surrounding and radially spaced from the rotation axis, an axially extending outer tubular wall arranged to surround the inner tubular wall spaced radially therefrom, a first end wall extending between the inner and outer tubular walls, and a second end wall extending between the inner and outer tubular walls at the end of the chamber opposite said first end wall;

the inner tubular wall having a liquid transfer passage extending therethrough, displaced from the first end, and the first end wall having vessel outlet passage therethrough, displaced radially from the outer tubular wall, capable of passing liquid at a greater rate than the transfer passage;

the rotor also comprising a liquid inlet region defined by, and disposed radially inwardly of, the inner tubular wall, a bearing for supporting the rotor with respect to the housing and liquid powered turbine;

wherein the turbine comprises a liquid reaction drive having a drive member, secured with respect to the vessel, including a collar at said first end of the inlet region, arranged to fit in substantially liquid tight manner about the spindle in use, and at least one arm extending radially from the collar overlying the first end wall of the vessel, each arm carrying remotely of the collar a substantially tangentially directed reaction jet nozzle and defining a drive liquid conduit between the inlet region and nozzle;

said vessel outlet passage comprising at least one passage having a discharged liquid guide extending away from the first end wall arranged to discharge liquid expelled from the chamber axially further from the first end wall than each nozzle of the drive;

and an inlet region closure co-operable with the spindle in use to permit liquid supplied by the spindle to the inlet region at elevated pressure from leaving other than through the transfer passage and the liquid reaction drive, and wherein the first end wall of the vessel has therein a recess corresponding to each radially extending arm of the drive member, each arm overlying and closing a respective radially extending recess and defining at least partly within said recess a drive liquid conduit.

2. A rotor according to claim 1, wherein each drive member arm has an upstanding peripheral rib, and the associated first end wall recess is dimensioned to receive said rib therein.

3. A rotor according to claim 1, wherein the vessel is shaped such that the first end of the inner tubular wall has adjacent said first end a recess of increased diameter to receive the drive member collar.

4. A rotor according to claim 1, wherein the discharged liquid guide comprises a skirt associated with and at least partially surrounding each discharge passage.

5. A rotor according to claim 1, wherein the discharged liquid guide comprises a skirt bounding all of the outlet passages.

6. A rotor according to claim 1, which is suitable for a separator in which the spindle is fixed with respect to the housing, in which the bearing comprises at least two axially spaced bearings and at least one bearing is a bush arranged in use to form a collar about the spindle lubricated by said liquid in the inlet region and define thereby said closure.

7. A rotor according to claim 1, wherein the bearing is carried by the inner tubular wall at said second end.

8. A rotor according to claim 1, wherein the bearing is carried in the collar of the drive.

9. A rotor according to claim 8, wherein the first end of the inner tubular wall is supported with respect to the rotation axis by the collar of the drive member.

10. A rotor according to claim 1, wherein the second end wall of the vessel is formed as an annular cap surrounding the inner tubular wall at said second end and secured to the second end of the outer tubular wall.

11. A rotor according to claim 1, wherein the inner tubular wall, outer tubular wall and first end wall of the vessel are formed integrally with each other.

12. A rotor according to claim 11, wherein the inner tubular wall, outer tubular wall and first end wall of the vessel are formed as a unitary molding of synthetic resin material.

13. A rotor according to claim 12, wherein the discharged liquid guide comprises a skirt bounding all of the outlet passages, said skirt being molded at least in part integrally with the end wall of the vessel.

14. A rotor according to claim 1, wherein the drive member is secured with respect to the vessel via each drive member arm and the first end wall.

15. A rotor according to claim 1, wherein the drive member is formed as a unitary molding of synthetic resin material.

16. A rotor according to claim 15, wherein the discharged liquid guide comprises a skirt bounding all of the outlet passages, and at least part of said skirt is molded integrally with the drive member.

17. A rotor according to claim 15, wherein the drive member is secured with respect to the vessel by an adhesive or by ultrasonic welding.

18. A rotor according to claim 1, wherein the rotor is arranged in an operating position in which the rotational axis is substantially vertical and the first end wall of the rotor is lowermost.

19. A rotor for a fluid driven centrifugal separator having a housing comprising a base and a cover and within the housing spindle extending from the base to support for rotation a said rotor and having a through duct to communicate fluid at elevated pressure from the base to the rotor;

the rotor comprising a contaminant separation and containment vessel having a rotation axis and, extending axially between first and second ends, an annular chamber defined by an axially extending inner tubular wall surrounding and radially spaced from the rotation axis, an axially extending outer tubular wall arranged to surround the inner tubular wall spaced radially therefrom, a first end wall extending between the inner and outer tubular walls, and a second end wall extending between the inner and outer tubular walls at the end of the chamber opposite said first end wall;

the inner tubular wall having a liquid transfer passage extending therethrough, displaced from the first end, and the first end wall having vessel outlet passage therethrough, displaced radially from the outer tubular wall, capable of passing liquid at a greater rate than the transfer passage;

the rotor also comprising a liquid inlet region defined by, and disposed radially inwardly of, the inner tubular wall, a bearing for supporting the rotor with respect to the housing and liquid powered turbine;

wherein the turbine comprises a liquid reaction drive having a drive member, secured with respect to the vessel, including a collar at said first end of the inlet region, arranged to fit in substantially liquid tight manner about the spindle in use, and at least one arm extending radially from the collar overlying the first end wall of the vessel, each arm carrying remotely of the collar a substantially tangentially directed reaction jet nozzle and defining a drive liquid conduit between the inlet region and nozzle;

said vessel outlet passage comprising at least one passage having a discharged liquid guide extending away from the first end wall arranged to discharge liquid expelled from the chamber axially further from the first end wall than each nozzle of the drive;

and an inlet region closure co-operable with the spindle in use to permit liquid supplied by the spindle to the inlet region at elevated pressure from leaving other than through the transfer passage and the liquid reaction drive, and wherein each drive member arm comprises a liquid containment surface open towards said first end wall of the vessel and with said end wall defines a drive liquid conduit extending between the inlet region and a nozzle.

20. A rotor according to claim 19, wherein the drive member arm defines said liquid containment surface as a trough.

21. A rotor for a fluid driven centrifugal separator having a housing comprising a base and a cover and within the housing spindle extending from the base to support for rotation a said rotor and having a through duct to communicate fluid at elevated pressure from the base to the rotor;

the rotor comprising a contaminant separation and containment vessel having a rotation axis and, extending axially between first and second ends, an annular chamber defined by an axially extending inner tubular wall surrounding and radially spaced from the rotation axis, an axially extending outer tubular wall arranged to surround the inner tubular wall spaced radially therefrom, a first end wall extending between the inner and outer tubular walls, and a second end wall extending between the inner and outer tubular walls at the end of the chamber opposite said first end wall;

the inner tubular wall having a liquid transfer passage extending therethrough, displaced from the first end, and the first end wall having vessel outlet passage therethrough, displaced radially from the outer tubular wall, capable of passing liquid at a greater rate than the transfer passage;

the rotor also comprising a liquid inlet region defined by, and disposed radially inwardly of, the inner tubular wall, a bearing for supporting the rotor with respect to the housing and liquid powered turbine;

wherein the turbine comprises a liquid reaction drive having a drive member, secured with respect to the vessel, including a collar at said first end of the inlet region, arranged to fit in substantially liquid tight manner about the spindle in use, and at least one arm extending radially from the collar overlying the first end wall of the vessel, each arm carrying remotely of the collar a substantially tangentially directed reaction jet nozzle and defining a drive liquid conduit between the inlet region and nozzle;

said vessel outlet passage comprising at least one passage having a discharged liquid guide extending away from the first end wall arranged to discharge liquid expelled from the chamber axially further from the first end wall than each nozzle of the drive;

and an inlet region closure co-operable with the spindle in use to permit liquid supplied by the spindle to the inlet region at elevated pressure from leaving other than through the transfer passage and the liquid reaction drive, and wherein at least one discharged liquid guide terminates in a nozzle open in a discharge direction inclined relative to the rotor axis.

22. A rotor according to claim 21, wherein at least one nozzle discharge direction is inclined substantially perpendicularly to the rotor axis.

23. A rotor according to claim 21, wherein at least one nozzle is open in a discharge direction, said discharge direction having a component which is directed radially outwardly or in a tangentially trailing direction, or both, relative to the rotor rotation direction.

24. A centrifugal separator for separating particulates from a liquid comprising:

a housing having a base, arranged to be coupled to a source of contaminated liquid at elevated pressure;

a spindle, mounted with respect to the base and having a duct to communicate fluid at elevated pressure from the base;

a cover secured with respect to the base; and a rotor mounted within the housing on the spindle for rotation and to receive said liquid at elevated pressure from the spindle, said rotor comprising a contaminant separation and containment vessel having a rotation axis and, extending axially between first and second ends, an annular chamber defined by an axially extending inner tubular wall surrounding and radially spaced from the rotation axis, an axially extending outer tubular wall arranged to surround the inner tubular wall spaced radially therefrom, a first end wall extending between the inner and outer tubular walls, and a second end wall extending between the inner and outer tubular walls at the end of the chamber opposite said first end wall;

the inner tubular wall having a liquid transfer passage extending therethrough, displaced from the first end, and the first end wall having vessel outlet passage therethrough, displaced radially from the outer tubular wall, capable of passing liquid at a greater rate than the transfer passage;

the rotor also comprising a liquid inlet region defined by, and disposed radially inwardly of, the inner tubular wall, a bearing for supporting the rotor with respect to the housing and liquid powered turbine;

wherein the turbine comprising liquid reaction drive having a drive member, secured with respect to the vessel, including a collar at said first end of the inlet region, arranged to fit in substantially liquid tight manner about the spindle in use, and at least one arm extending radially from the collar overlying the first end wall of the vessel, each arm carrying remotely of the collar a substantially tangentially directed reaction jet nozzle and defining a drive liquid conduit between the inlet region and nozzle;

said vessel outlet passage comprising at least one passage having a discharged liquid guide extending away from the first end wall arranged to discharge liquid expelled from the chamber axially further from the first end wall than each nozzle of the drive, and an inlet region closure co-operable with the spindle in use to permit liquid supplied by the spindle to the inlet region at elevated pressure from leaving other than through the transfer passage and the liquid reaction drive;

wherein the first end wall of the vessel has therein a recess corresponding to each radially extending arm of the drive member, each arm overlying and closing a respective radially extending recess and defining at least partly within said recess a drive liquid conduit.

25. A liquid cleaning arrangement comprising means to supply contaminated liquid at elevated pressure and a centrifugal separator as claimed in claim 24.

* * * * *